United States Patent [19]

Burgess

[11] 3,989,226

[45] Nov. 2, 1976

[54] POST-MOUNTED FENCE BOARD SUPPORT BRACKETS

[76] Inventor: Allen L. Burgess, 711 Emerson St. NE., Washington, D.C. 20017

[22] Filed: Sept. 8, 1975

[21] Appl. No.: 611,014

[52] U.S. Cl. ..... 256/65; 403/310

[51] Int. Cl.[2] ..... E04H 17/14

[58] Field of Search ..... 403/310, 217, 219, 405; 248/300; 52/758 A; 256/59, 65, 1

[56] References Cited

UNITED STATES PATENTS

| | | | |
|---|---|---|---|
| 1,749,637 | 3/1930 | Kingston | 403/310 |
| 2,426,283 | 8/1947 | Pearson | 403/310 |
| 2,884,670 | 5/1959 | Garrison et al. | 248/300 |
| 3,633,862 | 1/1972 | Breen | 256/59 |

*Primary Examiner*—Werner H. Schroeder
*Assistant Examiner*—Doris L. Troutman
*Attorney, Agent, or Firm*—Walter S. Pawl

[57] ABSTRACT

The bracket assembly comprises a pair of opposed channel plates supporting a fence board clamped therebetween, and having a bearing sleeve portion extending from one of said plates through a bore in the fence post in which said brackets are mounted, the other of said pair of plates having a bolt extending therefrom through said sleeve, and a nut on the end of the bolt for suitably tightening a washer on said bolt against said post and the outer end of said sleeve.

3 Claims, 4 Drawing Figures

POST-MOUNTED FENCE BOARD SUPPORT BRACKETS

BACKGROUND OF THE INVENTION

Fence boards have normally been nailed or bolted directly to the fence posts or held loosely in support hooks or brackets mounted on the post. Such support means often marred the boards and needed periodic attention and repairs. There was a need for a more sturdy arrangement for mounting the boards more firmly on the posts without damaging or weakening the boards, yet allowing them some angular adjustment relative to the post, if they were to be held in an inclined position, as in a fence going up and down a hillside, or in a criss-cross board fence arrangement.

SUMMARY OF THE INVENTION

The object of this invention is therefore to devise a neat, strong and durable fence board support bracket that is simple to make, easy to install on a fence post and will not weaken or damage the fence board.

A further object is to make a board support bracket that will firmly clamp over the board and may be swivably mounted in a bore through the post for angular adjustment relative thereto.

Other and more specific objects will become apparent in the following detailed description of the invention as illustrated in the accompanying drawing, wherein.

DETAILED DESCRIPTION OF THE INVENTION

Figure 1:
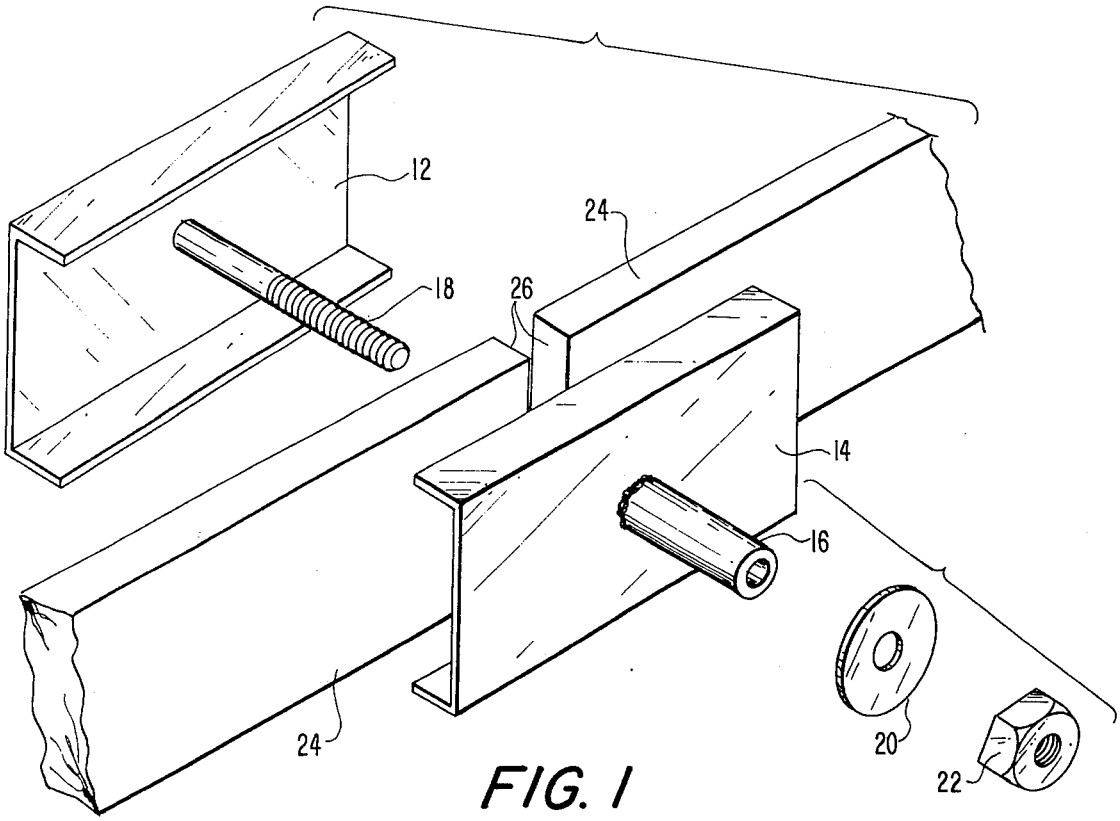
FIG. 1 is an exploded view of a preferred form of brackets made in accordance with the present invention.

Referring now in detail to the drawing, the bracket assembly 10 is composed of opposed channel brackets 12 and 14 with nesting flanges providing a closed rectangular clamping space for boards up to a thickness equal to the combined depths of the opposed channels.

Channel bracket 14 has an outwardly extending sleeve portion 16 mounted in a bore in the post 28, and a bolt 18 extending from the other channel bracket 12 is passed through said sleeve to receive a washer 20 and a nut 22 on the end thereof for tightening the hold on the board between the bottoms of the bracket channels, and for pushing the sleeve through the post bore and to bring the bracket 14 snugly against the face of the post.

The sleeve 16 may be made substantially equal in length to the thickness of the post in which it is to be mounted, so that the nut 22 may push the washer 20 against the post and the outer end of the sleeve 18, and clamp the board 24 tightly between the bottoms of the opposed bracket channels.

Figure 2:
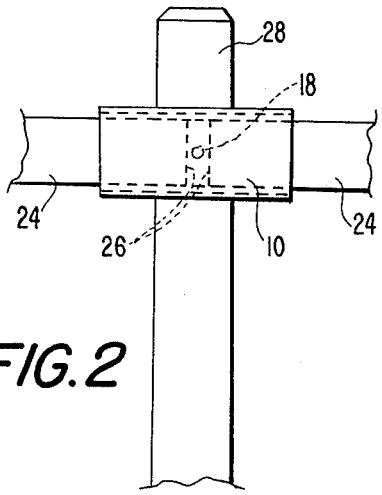
FIG. 2 is a front view of a fence post on which these brackets are mounted, holding the abutting ends of two boards extending in opposite directions therefrom.
Figure 3:
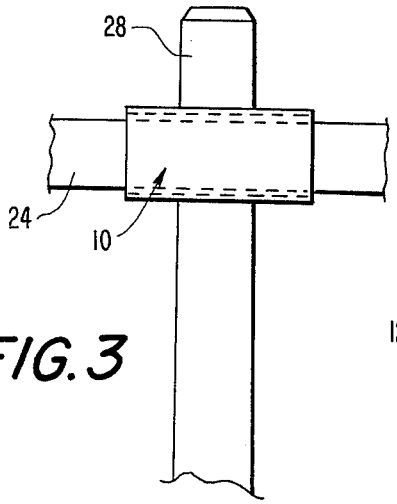
FIG. 3 is a similar view of these brackets holding a single board provided with a bore for the bolt passing therethrough.
Figure 4:
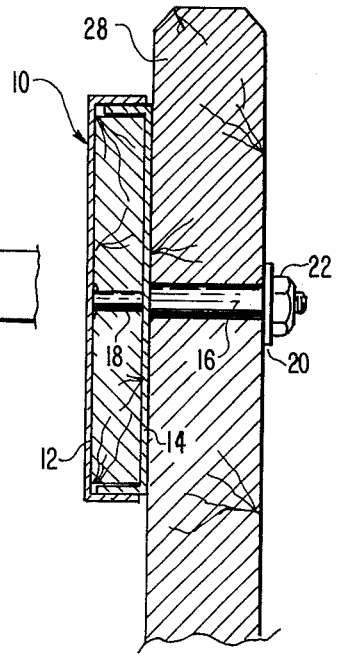
FIG. 4 is an enlarged vertical sectional view taken sxially of the combination shown in FIG. 3.

Thus a single fence board may be mounted as shown in FIGS. 3 and 4, or the abutting ends of two coextensive boards may be mounted as shown in FIGS. 1 and 2. In any case, the brackets provide a neat outside appearance and are easily mounted in a bore in the fence post, forming a strong and durable self-aligning suspension for the fence boards.

The sleeve 18 and the bolt 16 could be made separately from the bracket plates and the plates provided with boltholes for passing a bolt therethrough in forming the same assembly.

Many other obvious modification in form and structure may be made without departing from the spirit and scope of the present invention.

What is claimed is:

1. A bracket assembly for mounting boards on fence posts, comprising a pair of opposed channel bracket plates adapted for holdng a board therebetween, a sleeve extending from the back of one of said plates adapted for mounting in a corresponding bore extending through a fence post, a bolt extending from the inside of the other plate through said sleeve, and a washer and nut for said bolt to clamp said assembly and said board and post together.

2. A bracket assembly as defined in claim 1, said channel bracket plates having nesting flanges to form a closed rectangular clamping space wherein to firmly grip a board between them.

3. A bracket assembly, as defined in claim 1, said sleeve being of a length substantially equal to the thickness of a fence post on which it is to be mounted.

* * * * *